US005296056A

United States Patent [19]

Jain et al.

[11] Patent Number: 5,296,056

[45] Date of Patent: Mar. 22, 1994

[54] TITANIUM ALUMINIDE ALLOYS

[75] Inventors: Sushil K. Jain; James R. Roessler, both of Indianapolis, Ind.

[73] Assignee: General Motors Corporation, Detroit, Mich.

[21] Appl. No.: 966,815

[22] Filed: Oct. 26, 1992

[51] Int. Cl.[5] ..... C22C 14/00

[52] U.S. Cl. ..... 148/421; 148/403; 420/418; 420/421

[58] Field of Search ..... 148/421, 403; 420/418, 420/421

[56] References Cited

U.S. PATENT DOCUMENTS

| | | | |
|---|---|---|---|
| 4,383,970 | 5/1983 | Komuro et al. | 420/528 |
| 4,661,316 | 4/1987 | Hashimoto et al. | 420/418 |
| 4,788,035 | 11/1988 | Gigliotti, Jr. et al. | 420/420 |
| 4,834,036 | 5/1989 | Nishiyama et al. | 123/188 A |
| 4,874,577 | 10/1989 | Wakita et al. | 420/417 |
| 4,897,127 | 1/1990 | Huang | 148/133 |
| 4,923,534 | 5/1990 | Huang et al. | 420/418 |
| 5,030,300 | 7/1991 | Hashimoto et al. | 148/403 |
| 5,041,262 | 8/1991 | Gigliotti, Jr. | 420/419 |
| 5,045,406 | 9/1991 | Huang | 428/614 |
| 5,082,624 | 1/1992 | Huang | 420/418 |
| 5,089,225 | 2/1992 | Huang | 420/418 |
| 5,123,980 | 6/1992 | Hashimoto et al. | 148/403 |

FOREIGN PATENT DOCUMENTS

| | | | |
|---|---|---|---|
| 0455005 | 11/1991 | European Pat. Off. | C22C 14/00 |
| 3-193837 | 8/1991 | Japan | C22C 14/00 |

OTHER PUBLICATIONS

Kim et al Jour. of Metals, Aug. 1991, pp. 40–47.

*Primary Examiner*—Upendra Roy
*Attorney, Agent, or Firm*—George A. Grove

[57] ABSTRACT

A family of gamma titanium aluminide alloys is provided which is based on the intermetallic compound TiAl and includes alloying additions which enable the alloys to exhibit both sufficient mechanical properties and environmental capabilities for use in high temperature applications associated with gas turbine and automotive engines. The preferred alloys have a nominal aluminum content of about 46 atomic percent and further include niobium at about three to about five atomic percent and tungsten at about one atomic percent nominally, so as to selectively enhance the oxidation resistance of the alloy. As species of the preferred alloy, alloying additions of vanadium, chromium and manganese can be included at levels of up to about two atomic percent to enhance the toughness and ductility of the preferred alloy at lower temperatures, such as those encountered during fabrication and during low temperature operations.

17 Claims, 3 Drawing Sheets

TITANIUM ALUMINIDE ALLOYS

The invention herein described was made in the course Of work under a contract or subcontract thereunder with the Department of the Navy.

The present invention generally relates to alloys of titanium and aluminum which are relatively light weight and exhibit high strength and oxidation resistance at elevated temperatures. More particularly, this invention relates to gamma titanium aluminide alloys based on the intermetallic compound TiAl, with controlled additions of niobium and tungsten for enhancing oxidation resistance and high temperature creep strength, and alternatively, further additions of vanadium, chromium and/or manganese for providing greater toughness and ductility at operating temperatures.

BACKGROUND OF THE INVENTION

Because weight and high temperature strength are primary considerations in gas turbine engine design, there is a continuing effort to create relatively light weight alloys which have high strength at elevated temperatures. Titanium-based alloy systems are well known in the prior art as having mechanical properties which are suitable for relatively high temperature applications, with a practical upper limit being generally about 1100° F. However, as a result, these titanium-based alloys are typically not practical for many high temperature gas turbine engine applications which require usage at temperatures much higher than 1100° F. Thus, for many of these high temperature gas turbine applications, the use of heavier superalloys that are roughly twice as heavy as titanium-based alloys is necessitated.

The high temperature capability of titanium-based alloys has been gradually increased by the use of titanium intermetallic systems based on the titanium aluminides $Ti_3Al$ (alpha-2 alloys) and TiAl (gamma alloys). Generally, $Ti_3Al$-based alloys typically contain aluminum in amounts between about 23 and about 25 atomic percent, and TiAl-based alloys typically contain aluminum in amounts between about 46 and about 52 atomic percent. These titanium aluminide alloys are generally characterized as being relatively light weight, yet exhibit high strength, creep strength and fatigue resistance at elevated temperatures of up to about 1830° F., according to the ASM Handbook, vol. 2, p. 926 (1990).

However, these binary titanium aluminide alloys have a significant shortcoming in terms of their low ductility and corresponding brittleness and low fracture toughness at room temperature, which makes them difficult to process. In addition, these alloys do not exhibit desired high oxidation resistance due to their tendency to form titanium dioxide ($TiO_2$) rather than aluminum oxide ($Al_2O_3$) at high temperatures. For example, the oxidation limit for the gamma TiAl alloys is significantly less than its creep limit of 1830° F. Accordingly, a common objective with the use of titanium aluminide alloys is to achieve a good balance between mechanical properties at both room temperature and elevated temperatures, and environmental characteristics, such as oxidation resistance.

Gamma TiAl alloys, such as Ti-48Al-1V (atomic percent), generally possess temperature capabilities and densities which are superior to that of the $Ti_3Al$ alpha-2 alloys. As a result, gamma TiAl alloys generally have greater potential as an alloy suitable for the high temperature applications of gas turbine engines. However, the Ti-48Al-1V alloy has been found to be susceptible to a relatively rapid rate of oxidation at temperatures between about 1400° F. and about 1600° F. To solve this shortcoming, it is known to add niobium and/or tantalum to improve the oxidation resistance of the alloy. This oxidation resistance is largely the result of an improvement in the physical and chemical properties of an oxidized layer which forms on the alloy as a protective coating. When the alloy is exposed to an oxidizing environment, the protective coating forms which is essentially a mixture of titanium dioxide and alpha alumina.

In addition, niobium and tantalum are known to improve the strength of the TiAl alloys. However, niobium and tantalum are generally considered to reduce ductility, an adverse condition which already exists in conventional TiAl alloys.

It is also known to add tungsten to improve the oxidation resistance of titanium aluminide alloys. In addition, tungsten additions are also known to significantly improve the creep strength behavior of titanium aluminide alloys. However, as with niobium and tantalum, tungsten is also generally considered to reduce the ductility of an alloy, which would be expected to further exacerbate the low ductility seen in conventional TiAl alloys.

For improving ductility, alloying additions of vanadium, chromium and manganese have been reported to be effective. However, these alloying elements are also known to decrease oxidation resistance of the alloy. Accordingly, the need to achieve a balance between the mechanical properties and the environmental capabilities of gamma titanium aluminides is characterized by offsetting factors, so that this balance has not been realized in the prior art. This balance is further complicated by the desire for an alloy to be extrudable, forgable, rollable and castable, so as to enable the fabrication of various types of components, such as those for gas turbine and automotive engines. Yet it is also desirable for the alloy to be responsive to heat treatments, so as to permit tailored microstructures and mechanical properties for specific applications.

Thus, it would be desirable to provide a titanium aluminide alloy which exhibits both sufficiently high strength, creep resistance and oxidation resistance at elevated temperatures, while also being sufficiently ductile and fracture tough at room temperature so as to enable the alloy to be more readily processed, and thereby more readily permit the fabrication of relatively light weight components which can be tailored for use in high temperature environments, such as found within gas turbine as well as automotive engines.

SUMMARY OF THE INVENTION

It is an object of this invention to provide a relatively light weight alloy which exhibits both sufficient mechanical properties and environmental capabilities so as to be suitable for use in high temperature applications, such as that found in gas turbine and automotive engines.

It is a further object of this invention that such an alloy be a gamma titanium aluminide alloy based on the intermetallic compound TiAl.

It is still another object of this invention that such a titanium aluminide alloy include alloying additions which improve the oxidation resistance of the titanium aluminide alloy at elevated temperatures.

It is yet another object of this invention that such a titanium aluminide alloy include alloying additions which improve the ductility and fracture toughness of the titanium aluminide alloy at room temperature.

Lastly, it is still a further object of this invention that such a titanium aluminide alloy exhibit excellent extrudability, forgability, rollability and castability, while also having mechanical properties which are responsive to heat treatments.

In accordance with a preferred embodiment of this invention, these and other objects and advantages are accomplished as follows.

According to the present invention, there is provided a gamma titanium aluminide alloy, based on the intermetallic compound TiAl, and having an aluminum content of about 46 atomic percent, such that the resulting alloy is characterized by high strength at elevated temperatures in excess of about 1600° F. In addition, the preferred alloy contains a relatively high concentration of niobium and a relatively low concentration of tungsten to selectively enhance the oxidation resistance of the alloy at temperatures up to about 1800° F. Preferably, niobium is present in the alloy on the order of about three to about five atomic percent, and tungsten is present on the order of about 0.5 to about 1.5 atomic percent. The present invention has as a principal alloy, the approximate composition in atomic percents, Ti-46Al-5Nb-1W, and is referred to throughout as Alloy A (which is identified under the tradename Alloy 7 by Allison Gas Turbine Division of General Motors Corporation).

As species of the above alloy, relatively low alloying additions of vanadium, chromium and manganese can be included to enhance the toughness and ductility of the alloy at lower temperatures, such as those encountered during fabrication and during low temperature operations.

The preferred Ti-46Al-5Nb-1W composition is formed by adding the alloying elements niobium and tungsten, which dissolve in the TiAl phase. The family of alloys of this invention may be produced in cast or wrought form. Castings are hot isostatic press (HIP) densified and, where appropriate, heat treated to enhance the mechanical properties of the alloy. Wrought forms, such as forgings, are made from cast/HIPed material, and also heat treated to enhance mechanical properties.

Generally, the preferred family of Ti-46Al-5Nb-1W alloys exhibit excellent metallurgical stability, have suitable ductility/fracture toughness at lower temperatures and tensile/creep rupture strength at high temperatures, and have excellent cyclic oxidation resistance to about 1800° F. In addition, the preferred Ti-46Al-5Nb-1W alloy is highly extrudable, forgable, rollable and castable. With the selective addition of vanadium, chromium and manganese, the alloy exhibits even better ductility and fracture toughness, thereby further promoting fabrication and mechanical properties at room temperature.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
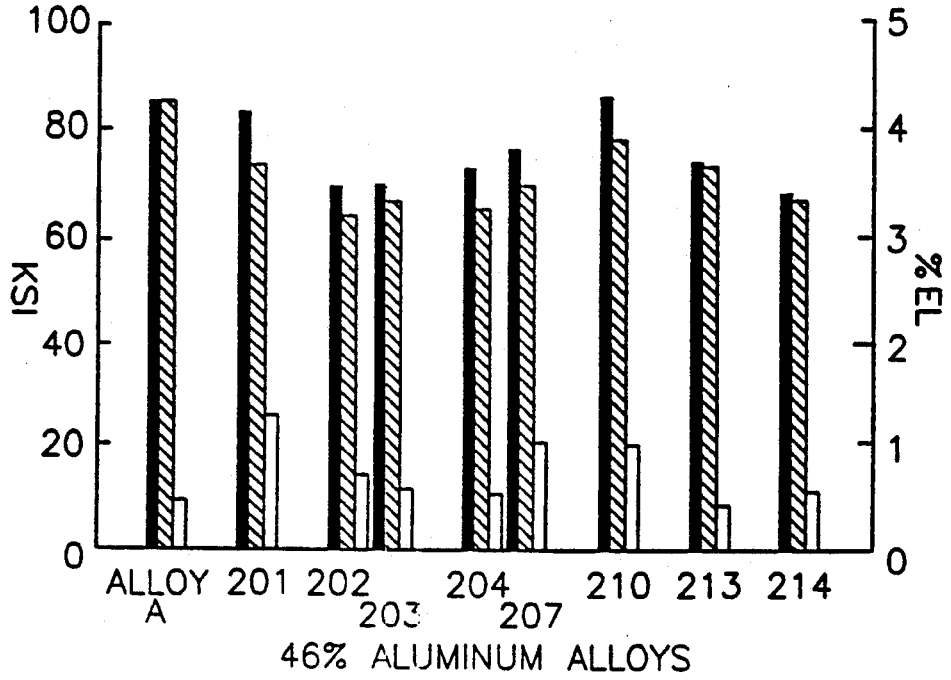
FIG. 1 is a graph illustrating the room temperature tensile properties of a selected group of alloys prepared in cast form in accordance with this invention.

A family of gamma titanium aluminide alloys is provided which is based on the intermetallic compound TiAl and includes alloying additions, in accordance with this invention, which enable the alloy to exhibit mechanical properties and environmental capabilities such that the preferred alloys of this invention are suitable for use in high temperature applications.

The preferred titanium-aluminide-based alloys have an aluminum content of about 46 atomic percent, such that the alloy is characterized by having high strength at elevated temperatures in excess of about 1600° F. This level of aluminum in the preferred alloys was selected over the more conventional aluminum content of 48 atomic percent (e.g., the Ti-48Al-1V alloy) because the lower aluminum content resulted in significantly higher strength as compared to the Ti-48Al-1V alloy.

The preferred alloys also contain niobium at levels of about three to about five atomic percent and tungsten at levels of about 0.5 to about 1.5 atomic percent, both of which serve to selectively enhance the oxidation resistance of the preferred alloy. In accordance with the above, the present invention has as a preferred alloy the composition in atomic percents Ti-46Al-5Nb-1W.

As species of the preferred alloy, alloying additions of vanadium, chromium and manganese can be included at levels of up to about two atomic percent, so as to enhance the toughness and ductility of the preferred alloy at lower temperatures, such as those encountered during fabrication and during low temperature operations.

As previously stated, while titanium aluminide alloys can generally be typified as being relatively light weight with high strength, creep strength and fatigue resistance at elevated temperatures of up to about 1830° F., these alloys have a significant shortcoming in terms of their brittleness/low ductility and low fracture toughness at room temperature, which makes them difficult to process under typical processing conditions. In addition, these alloys do not exhibit high oxidation resistance at elevated temperatures in excess of about 1650OF due to their tendency to form titanium dioxide rather than aluminum oxide.

Accordingly, for titanium aluminide alloys to find practical uses at temperatures in excess of about 1650° F., a suitable balance between mechanical properties, at both room temperature and elevated temperatures, and oxidation resistance must be achieved.

In accordance with this invention, the preferred family of alloys, based on the Ti-46Al-5Nb-1W alloy, succeeds in exhibiting good mechanical properties and oxidation resistance at temperatures of up to about 1800° F., while also having sufficient ductility and fracture toughness such that conventional processing methods, such as casting, forging, rolling and extruding, are feasible. As a result, the preferred Ti-46Al-5Nb-1W alloy is highly suitable for high temperature applications, such as the impellers, turbine blades and structural components of advanced gas turbine engines, as well as numerous other applications such as supercharger rotors and exhaust valves for automobiles.

Niobium and tungsten are present in the preferred alloy of this invention to improve the oxidation resistance of the alloy, as well as to improve the tensile strength and creep rupture capability of the preferred Ti-46Al-5Nb-1W alloy. As a result of the presence of niobium and tungsten, the preferred Ti-46Al-5Nb-1W alloy forms a protective coating which is essentially a mixture of alpha alumina and titanium dioxide at elevated temperatures, thereby enhancing the oxidation resistance of the alloy.

Though both niobium and tungsten can sometimes have an adverse effect on ductility, the preferred Ti-46Al-5Nb-1W alloy exhibits sufficient ductility and fracture toughness for many applications. This alloy has room temperature fracture toughness as high as 17 ksi-in$^{.5}$ and plastic ductility as high as 1.6 percent. However, for applications which require higher ductility and fracture toughness, the gamma titanium aluminide alloy of this invention is further alloyed with additions of vanadium, chromium and manganese of up to about two atomic percent.

As shown in Table I, the possible combinations encompassed by the above alloying additions have been categorized to include the following family of 30 alloys which exhibit the mechanical and environmental capabilities in accordance with this invention. Alloy A designates the preferred Ti-46Al-5Nb-1W alloy of this invention. Alloys 201 through 227 are indicated as having a niobium level of about three atomic percent, which is less than that of the preferred Ti-46Al-5Nb-1W alloy. This was done to offset the increased density caused by the addition of vanadium, chromium and/or manganese in the preferred Ti-46Al-5Nb-1W alloy. Because testing indicated that niobium is a potent alloying element for oxidation resistance, it was believed that lowering the niobium level to about three atomic weight percent would not significantly affect the oxidation resistance of the resulting alloy. However, with a niobium content of 5 atomic percent, Alloy A and Alloys 228 through 230 exhibited better oxidation resistance than the other alloys.

TABLE I

| ALLOY NO. | DENSITY (lbs/in$^3$) | Ti | Al | Nb | W | V | Cr | Mn |
|---|---|---|---|---|---|---|---|---|
| | | (atomic percent) | | | | | | |
| Alloy A | 0.1464 | BAL | 46 | 5 | 1 | 0 | 0 | 0 |
| 201 | 0.1433 | BAL | 46 | 3 | 1 | 0 | 0 | 0 |
| 202 | 0.1439 | BAL | 46 | 3 | 1 | 0 | 0 | 1 |
| 203 | 0.1446 | BAL | 46 | 3 | 1 | 0 | 0 | 2 |
| 204 | 0.1439 | BAL | 46 | 3 | 1 | 0 | 1 | 0 |
| 205 | 0.1446 | BAL | 46 | 3 | 1 | 0 | 1 | 1 |
| 206 | 0.1452 | BAL | 46 | 3 | 1 | 0 | 1 | 2 |
| 207 | 0.1445 | BAL | 46 | 3 | 1 | 0 | 2 | 0 |
| 208 | 0.1452 | BAL | 46 | 3 | 1 | 0 | 2 | 1 |

TABLE I-continued

| ALLOY NO. | DENSITY (lbs/in$^3$) | Ti | Al | Nb | W | V | Cr | Mn |
|---|---|---|---|---|---|---|---|---|
| | | (atomic percent) | | | | | | |
| 209 | 0.1459 | BAL | 46 | 3 | 1 | 0 | 2 | 2 |
| 210 | 0.1437 | BAL | 46 | 3 | 1 | 1 | 0 | 0 |
| 211 | 0.1443 | BAL | 46 | 3 | 1 | 1 | 0 | 1 |
| 212 | 0.1450 | BAL | 46 | 3 | 1 | 1 | 0 | 2 |
| 213 | 0.1443 | BAL | 46 | 3 | 1 | 1 | 1 | 0 |
| 214 | 0.1450 | BAL | 46 | 3 | 1 | 1 | 1 | 1 |
| 215 | 0.1456 | BAL | 46 | 3 | 1 | 1 | 1 | 2 |
| 216 | 0.1449 | BAL | 46 | 3 | 1 | 1 | 2 | 0 |
| 217 | 0.1456 | BAL | 46 | 3 | 1 | 1 | 2 | 1 |
| 218 | 0.1463 | BAL | 46 | 3 | 1 | 1 | 2 | 2 |
| 219 | 0.1441 | BAL | 46 | 3 | 1 | 2 | 0 | 0 |
| 220 | 0.1447 | BAL | 46 | 3 | 1 | 2 | 0 | 1 |
| 221 | 0.1454 | BAL | 46 | 3 | 1. | 2 | 0 | 2 |
| 222 | 0.1447 | BAL | 46 | 3 | 1 | 2 | 1 | 0 |
| 223 | 0.1454 | BAL | 46 | 3 | 1 | 2 | 1 | 1 |
| 224 | 0.1460 | BAL | 46 | 3 | 1 | 2 | 1 | 2 |
| 225 | 0.1453 | BAL | 46 | 3 | 1 | 2 | 2 | 0 |
| 226 | 0.1460 | BAL | 46 | 3 | 1 | 2 | 2 | 1 |
| 227 | 0.1467 | BAL | 46 | 3 | 1 | 2 | 2 | 2 |
| 228 | 0.1472 | BAL | 46 | 5 | 1 | 2 | 0 | 0 |
| 229 | 0.1476 | BAL | 46 | 5 | 1 | 0 | 2 | 0 |
| 230 | 0.1477 | BAL | 46 | 5 | 1 | 0 | 0 | 2 |

The atomic percents listed above in Table I are nominal values.

It is believed that the atomic percent of the aluminum (Al) may vary from about 45 to about 47 atomic percent, most preferably about 45.5 to about 46.5 atomic percent, with the most preferred value being about 46 atomic percent. The aluminum reacts with the titanium so as to form titanium aluminides. In particular at this preferred level of aluminum, a combination of the alpha-2 ($Ti_3Al$) with predominantly gamma (TiAl) titanium aluminides is formed, so as to provide relatively high strength, creep strength and fatigue resistance at elevated temperatures.

In addition, the niobium (Nb) may vary from about two to about six atomic percent, most preferably from about three to about five atomic percent. The tungsten (W) may vary from about 0.25 to about two atomic percent, most preferably from about 0.5 to about 1.5 atomic percent, with the most preferred composition having about one atomic percent. The niobium and tungsten are present in the preferred family of alloys so as to improve the oxidation resistance of the alloy, as well as to improve the tensile strength and creep rupture capability of the preferred alloys. It is believed that the oxidation resistance is enhanced by the presence of niobium and tungsten because they promote the formation of a protective coating that consists essentially of a mixture of alpha alumina and titanium dioxide at elevated temperatures. Though both niobium and tungsten can sometimes have an adverse effect on ductility, the preferred ranges for these constituents permit sufficient ductility and fracture toughness for most applications.

Further, for applications which require higher ductility and fracture toughness, the preferred gamma titanium aluminide alloy of this invention is further alloyed with additions of vanadium, chromium and manganese of up to about three atomic percent each, most preferably the maximum being about two atomic percent each.

In addition, there may be incidental impurities, such as sulfur, oxygen, hydrogen, nitrogen, iron, phosphorous, carbon and silicon, within the alloy which are normally present in conventional titanium alloys. However, these are kept to as minimum a level as possible.

Figure 3:
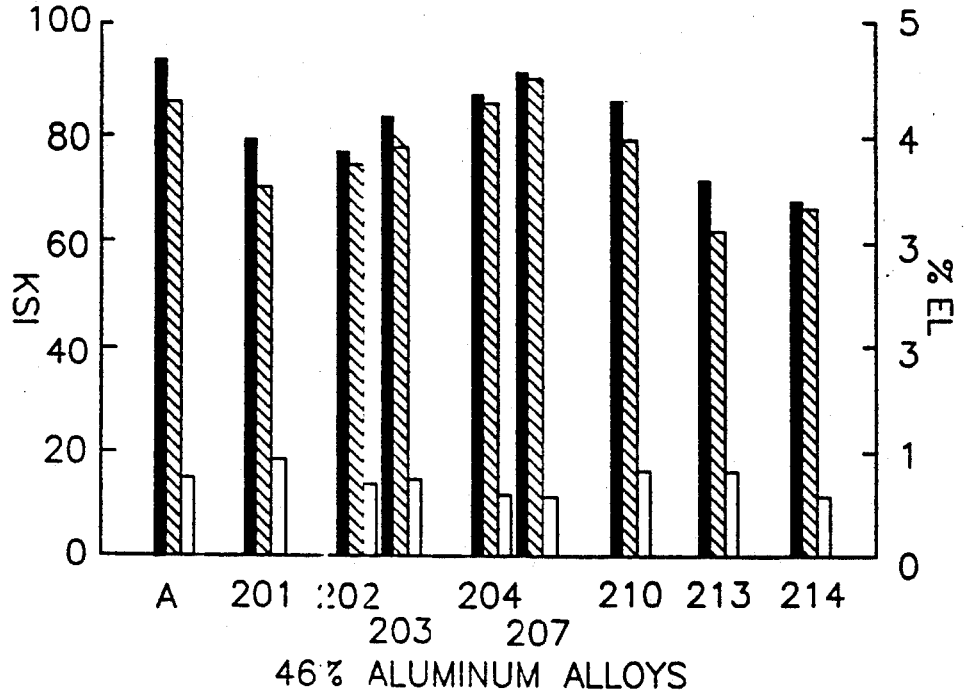
FIG. 3 is a graph illustrating the room temperature tensile properties of the same selected alloys which were prepared in the form of cast and heat treated specimens in accordance with this invention.
Figure 4:
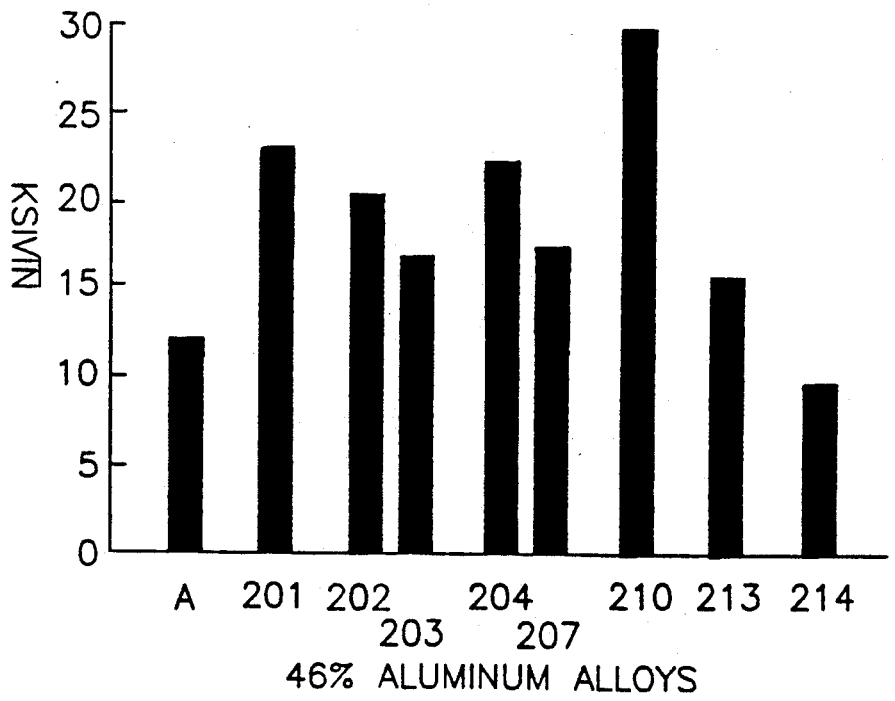
FIG. 4 is a graph illustrating the room temperature fracture toughness of the same selected alloys which were prepared like in FIG. 3.
Figure 5:
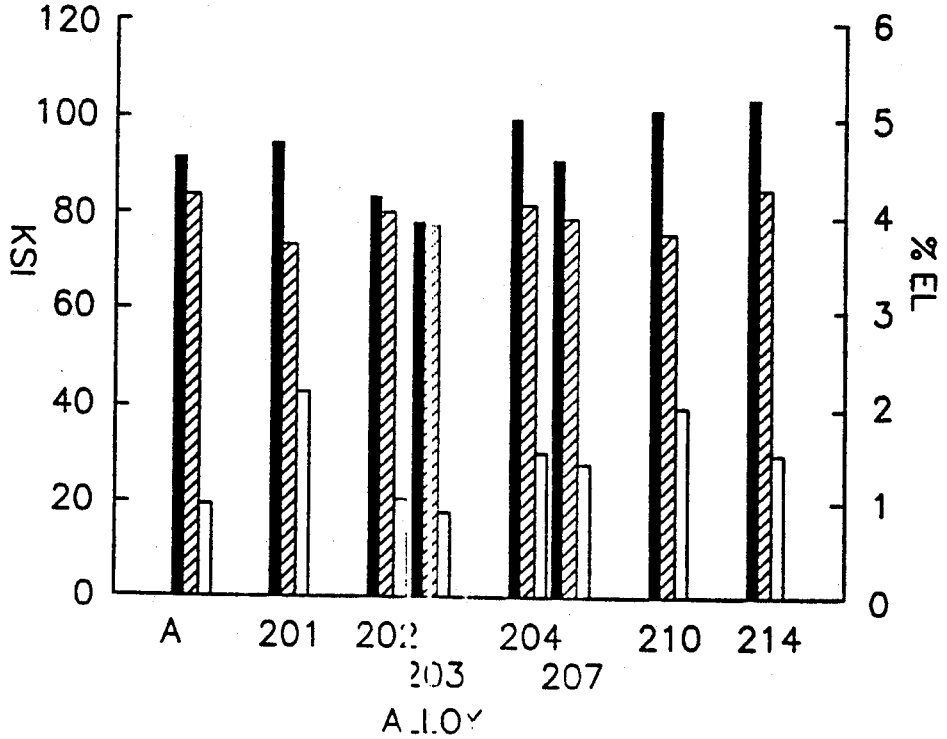
FIG. 5 is a graph illustrating the room temperature tensile properties of the same selected alloys which were prepared in the form of forged and heat treated specimens in accordance with this invention.
Figure 6:
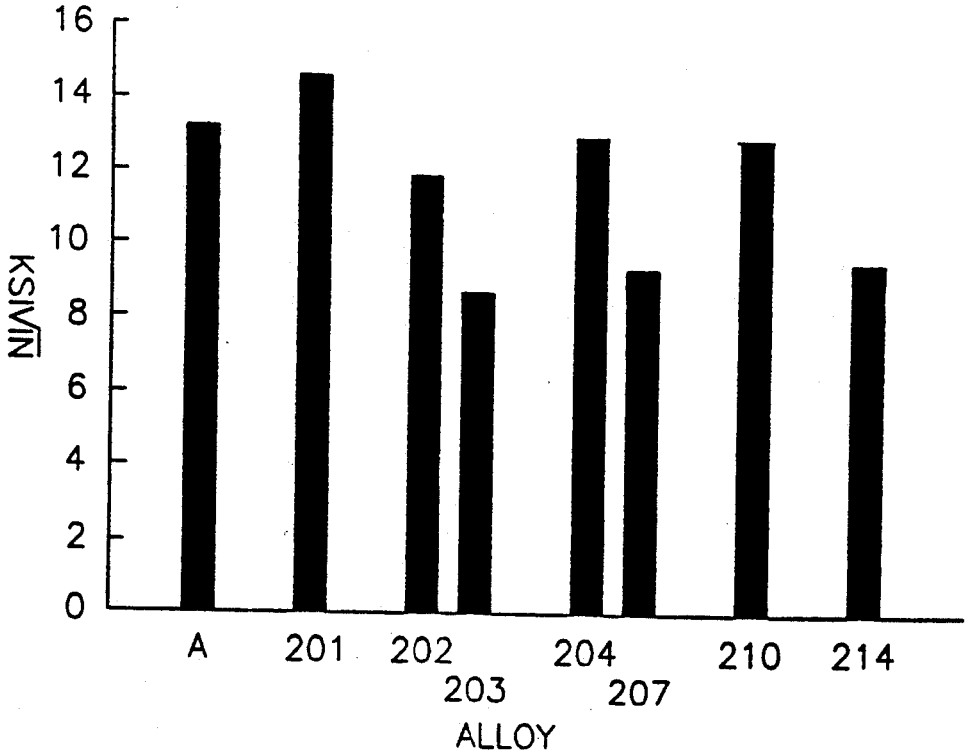
FIG. 6 is a graph illustrating the room temperature fracture toughness of the same selected alloys which were prepared like in FIG. 5.

Of the alloys listed above, Alloy A and Alloys 201, 202, 203, 204, 207, 210, 213 and 214 were shown to have the best potential for overall mechanical strength and environmental resistance characteristics, as more fully discussed below. As a result, the tensile strength and fracture toughness of only these alloys are illustrated in FIGS. 1 through 6 (FIGS. 5 and 6 do not include Alloy 213). However, all of the alloys indicated in Table I are the subject of this invention and will be discussed below in terms of both mechanical and environmental capabilities in view of the evaluation tests reported below.

For each of the test evaluations, two 250 gram buttons of each alloy described in Table I were formed by known arc melting techniques. The buttons were hot isostatic press (HIP) densified at about 2300° F. and about 25 ksi (one ksi = 1000 pounds per square inch) for about four hours. Each button was then analyzed for chemistry to ensure its composition and radiographed for soundness.

The compositional evaluations of the HIPed buttons indicated that each had a near uniform composition. Microstructures consisted of equiaxed grains of primary gamma (TiAl) and alpha-two ($Ti_3Al$)/gamma lamellar structure formed by eutectoid reactions. The microstructures of all samples were determined to be sufficiently similar such that mechanical properties would not be greatly influenced by microstructural variations and would be indicative of compositional differences.

Duplicate specimens of each alloy were then prepared and tested for cyclic oxidation resistance, room temperature fracture toughness and room temperature tensile strength.

As an initial evaluation, pins having a 0.15 inch diameter and a 1.5 inch length were prepared by wire electro-discharge machining (EDM). Each specimen underwent cyclic oxidation resistance testing using a temperature cycle of about 60 minutes at about 1800° F., then about 10 minutes at room temperature, for a total of 600 cycles. The test was conducted using a pair of fluidized beds of ceramic powder, each of which was operated at one of the test temperatures. The fluidized beds, of the type well known in the art, served to promote rapid heat transfer so as to maximize the thermal shock to the test specimens.

Based on weight change data, results of the oxidation tests indicated that, where no chromium was present, alloys having vanadium levels of zero and about one atomic percent (i.e., Alloys 201 through 203 and 210 through 212) performed best. Where chromium was present at about one atomic percent, alloys having a vanadium level of about one atomic percent (i.e., Alloys 213 through 215) performed best. Finally, where chromium was present at about two atomic percent, Alloy 217, having vanadium and manganese levels of about one atomic percent each, performed best. The level of chromium desired within the alloy depends on the desired requirements, such as ductility and oxidation resistance, for the particular application.

Room temperature fracture toughness tests were also conducted on specimens representative of each alloy in Table I. The fracture toughness tests were conducted on duplicate specimens machined using wire EDM procedures from HIPed buttons of the alloys in Table I. The specimens were 0.125 inch by 0.250 inch in cross section and 2.0 inches in length and featured a 0.125 inch long center notch having a width of 0.005 inch and a depth of 0.080 inch. The test was a standard single-edge notched beam four-point bend test.

Results of the fracture toughness tests indicated that, where no chromium was present, alloys having zero and about one atomic percent vanadium with no manganese (i.e., Alloys 201 and 210) performed best. Where about one atomic percent chromium was present, alloys having zero and about one atomic percent vanadium with no manganese (i.e., Alloys 204 and 213) performed best. Finally, where about two atomic percent chromium was present, Alloy 207, which has no vanadium or manganese present, performed best. Though results of the fracture toughness tests did not indicate any clear trends, Alloys 204, 205, 207, 214, 216 and 220 showed the best ductility of all alloys tested from Table I. However, again, the particular alloy chosen from the preferred family of alloys for a specific application will depend on the desired characteristics, such as strength and oxidation resistance, which must be considered.

Standard room temperature tensile tests were also conducted on tensile test specimens representative of each alloy in Table I, which had been machined from the original arc melted buttons. Results of the tensile tests indicated that alloy additions tended to have an adverse effect on strength. Alloy A had a tensile strength of about 96 ksi, which was the highest of all alloys tested. The strength of Alloy 201 was comparable to Alloy A, with a tensile strength of about 91 ksi. The further addition of only manganese at levels of about one and two atomic percent (i.e., Alloys 202 and 203) exhibited tensile strengths of greater than about 85 ksi.

From the above evaluations, nine alloys from the preferred family of alloys were selected for further testing: Alloys A, 201, 202, 203, 204, 207, 210, 213 and 214. Each alloy was tested in an as-cast form, while each but Alloy 213 was tested as an isothermal forging (isoforging). The isoforged specimens underwent microstructure evaluation, as well as mechanical testing and heat treat studies. The cast specimens underwent each of the above evaluations, as well as chemistry analysis, differential thermal analysis and environmental testing.

The results of the tensile and fracture toughness tests for the cast specimens are described below and accompanied by the graphs shown in FIGS. 1 through 4. The results of the tensile and fracture toughness tests for the isoforged specimens are discussed under a separate heading and accompanied by the graphs shown in FIGS. 5 and 6.

CAST SPECIMENS

Cast specimens of each of the nine selected alloys were densified by hot isostatic pressing (HIP) at about 2300° F. and a pressure of about 25 ksi for about four hours. Most of the cast/HIPed ingots had some degree of duplex microstructure and each tended to exhibit lamellar or near lamellar microstructures, with equiaxed grains of primary gamma and alpha-two/gamma lamellar structures being formed by eutectoid reactions.

The 1800° F. oxidation resistance test cycle described above for the initial evaluations was essentially repeated for this stage of the testing. The weight change was measured every 20 cycles, with the oxidation attack measured metallographically after a total of 1000 cycles.

Results of the oxidation tests indicated that oxidation resistance at 1800° F. was sufficient for all alloys tested during this stage. Except for the manganese-containing Alloys 202, 203 and 214, the alloys demonstrated excellent oxidation resistance similar to Alloy A. The poorer performances of Alloys 202, 203 and 214 indicated a possible need for an oxidation protective coating.

As a second environmental test, a 1650° F. hot corrosion test was conducted on the nine selected alloys. This test is set up to simulate the corrosive conditions encountered by the blades and vanes in the turbine section of a gas turbine engine. The test was conducted at about atmospheric pressure, the gas being formed by the combustion of No. 2 diesel oil doped with 1.0 weight percent sulfur and with synthetic sea water being injected into the products of combustion. The test specimens for this test were prepared from the cast ingots to be 0.125 inch in diameter and 2.5 inches in length. The specimens were removed from the test and fan cooled for visual examination every 24 hours, and metallographic evaluations were conducted after 100 hours.

Results of the hot corrosion test were evaluated by measuring the depth of corrosive attack. Alloy A had the best corrosion resistance, having an average corrosion attack slightly over about 0.001 inch deep. Alloy 201 and chromium-containing Alloys 204 and 207 performed slightly poorer than Alloy A, each having an average corrosion attack of less than about 0.0175 inch. The manganese-containing Alloys 202, 203 and 214 exhibited the greatest amount of corrosion, each having an average corrosion attack greater than about 0.002 inch.

The results of the room temperature tensile tests for the cast/HIPed specimens are provided in FIG. 1. For each alloy, as indicated on the bottom horizontal axis, the ultimate tensile strength (UTS) and yield strength (YS) are shown with their corresponding values in KSI, as well as the percent elongation (% EL) for each tensile specimen. As shown, Alloys A, 201 and 210 exhibited the highest ultimate tensile strength, each being in excess of 80 ksi.

Figure 2:
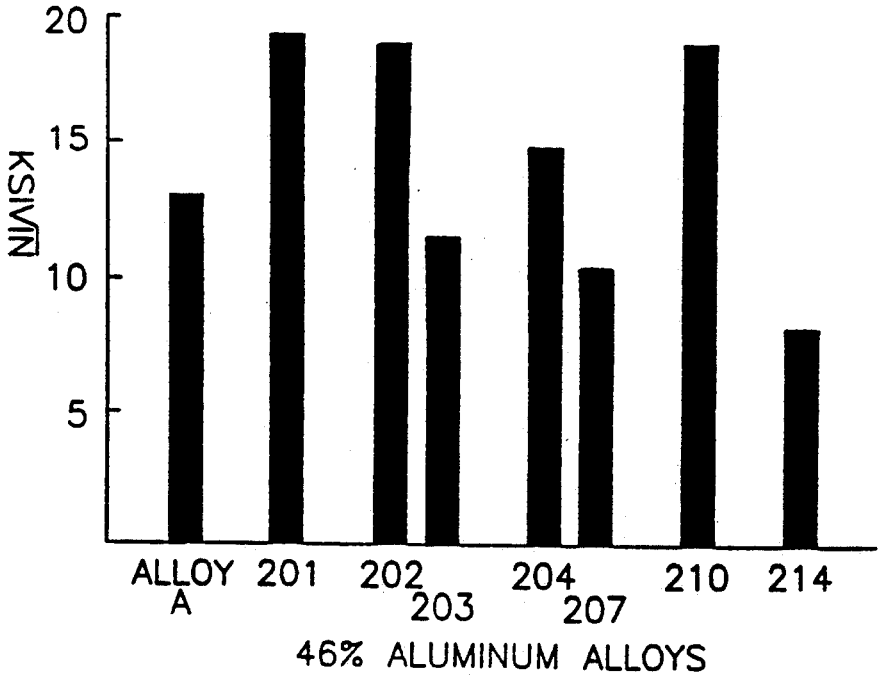
FIG. 2 is a graph illustrating the room temperature fracture toughness of the same selected alloys.

The results of the room temperature fracture toughness tests (in ksi-in$^{.5}$) for the several cast/HIPed alloy specimens are provided in FIG. 2. The tests were conducted identically to the previous fracture toughness tests reported above for the initial evaluations. From these results, it is apparent that Alloys 201, 202 and 210 exhibited the best fracture toughness, i.e., in excess of 15 ksi-in$^{.5}$. Alloy A also exhibited sufficient fracture toughness, about 13 ksi-in$^{.5}$. In that Alloy 201 does not include any additions of vanadium, chromium or manganese, the improvement in fracture toughness, as compared to Alloy A (Ti-46Al-5Nb-1W), is attributed to the lower niobium content, about three atomic percent, in the 201 alloy. Alloys 202 and 210 have additions of I atomic percent manganese and vanadium, respectively, each of which is the apparent cause for the improved fracture toughness in these alloys, as also compared to Alloy A.

Results of a heat treat response study on the cast specimens indicated that significant improvements in microstructural and mechanical properties could be achieved. The study included heat treatments at several temperatures ranging between about 2300° F. and about 2450° F. and within the titanium aluminide alpha+-gamma phase range. Overall, it appeared that strength and ductility levels did respond to changes in microstructure, which would permit the tailoring of the alloys for applications which require improved ductility and toughness.

From the results of the heat treat response study reported above, test specimens were again machined from the nine selected alloys but then heat treated at selected temperatures within the 2300° F. to 2450° F. range noted above. The heat treated specimens were then tested for tensile strength and fracture toughness, the results of which are shown in FIGS. 3 and 4. As shown, Alloys A, 203, 204, 207 and 210 each exhibited ultimate tensile strengths in excess of 80 ksi, with Alloy A exhibiting the highest ultimate tensile strength. The yield strength and percent elongation are also shown in FIG. 3 for these alloys.

The results of the room temperature fracture toughness tests for the cast/heat treated specimens indicated that Alloys 201, 204 and 210 exhibited fracture toughness in excess of 20 ksi-in$^{.5}$. In addition, all of the specimens but Alloy 214 exhibited better fracture toughness than Alloy A, yet the fracture toughness for all of the alloys shown would be sufficient for most applications.

ISOFORGED SPECIMENS

Specimens of each of the selected alloys, Alloys A, 201, 202, 203, 204, 207, 210 and 214, from the preferred family of alloys of this invention, were isothermally forged at about 2100OF at a strain rate of about 0.001 to 0.01 inch/inch/second from cast-hot isostatically pressed (HIPed) ingots. These isoforged specimens were then heat treated at a selected temperature within a range of about 2300° F. to about 2400° F. The isoforged specimens were tested for tensile strength and fracture toughness, the results of valves for automobiles. which are shown in FIGS. 5 and 6. These tests were conducted identically to the prior tensile and fracture toughness tests reported above for the initial evaluation of the cast/HIPed specimens.

As shown in FIG. 5, each of the Alloys exhibited an ultimate tensile strength in excess of 80 ksi, with Alloys 204, 210 and 214 being in excess of 100 ksi. The yield strengths of the alloys were also generally about 80 ksi, with elongations generally between about one and two percent.

The results of the room temperature fracture toughness tests for the isoforged/heat treated specimens are provided in FIG. 6. From these results, it is apparent that Alloys 201 and 210 again exhibited the best fracture toughness; however, the fracture toughness of these alloys is sufficient for most applications.

From the above overall results, it can be seen that the preferred alloy of this invention, Alloy A (Ti-46Al-5Nb-1W), and the alloys derived from Alloy A (Alloys 201 through 230), and particularly Alloys A, 201, 202, 204 and 210, exhibit suitable fracture toughness at room temperature while also exhibiting excellent cyclic oxidation resistance to a temperature of about 1800° F. As a result, the alloys of this invention are particularly suitable for high temperature applications, such as the impellers, turbine blades and structural components of advanced gas turbine engines, as well as numerous other applications, such as supercharger rotors and exhaust valves for automobiles.

Generally, each of the 30 alloys (Alloys 201 through 230) derived from Alloy A retains the above characteristics specific to Alloy A, with some improvements being observed as a result of the differing alloy compositions tested. Significantly, several of the alloys with alloying additions of vanadium, chromium and manganese are superior to Alloy A in terms of tensile strength, fracture toughness and oxidation resistance.

Another significant aspect of the alloys of this invention is that each alloy was found to be highly castable and forgable, with further indications for being highly extrudable and rollable. With a lower content of niobium and with about one atomic percent additions of vanadium, chromium or manganese (Alloys 201, 210, 204 and 202), better ductility and fracture toughness was achieved over Alloy A, thereby further promoting fabrication and mechanical properties at room temperature.

Generally, it was noted during each phase of testing that chromium additions slightly improved tensile strength, ductility and hot corrosion resistance properties, though fracture toughness was reduced when more than about one atomic percent chromium was added. Additions of vanadium appeared to have an even greater effect on tensile strength, ductility and fracture toughness properties, though there was evidence that oxidation and hot corrosion resistance was reduced when more than about one atomic percent vanadium was added. In addition, it appeared that a correlation exists between the microstructure of a particular alloy and its mechanical properties and that this correlation may be stronger than that which exists between the composition of the particular alloy and its mechanical properties.

Therefore, while our invention has been described in terms of a preferred embodiment, it is apparent that other compositional variations or fabrication methods could be adopted by one skilled in the art to formulate or fabricate materials which would not differ substantively from the alloys described above. Accordingly, the scope of our invention is to be limited only by the following claims.

The embodiments of the invention in which an exclusive property or privilege is claimed are defined as follows:

1. A gamma titanium aluminide alloy based on an intermetallic compound TiAl, the gamma titanium aluminide alloy consisting essentially of:

aluminum in an amount of about 45 to about 47 atomic percent;

niobium in an amount of about 2 to about 6 atomic percent;

tungsten in an amount of about 0.25 to about 2 atomic percent; and one or both elements selected from the group consisting of chromium and manganese, each of the one or both elements selected being present in an amount of from about 1 to about 2 atomic percent;

with the balance being titanium;

whereby the gamma titanium aluminide alloy exhibits oxidation resistance and fracture toughness.

2. A gamma titanium aluminide alloy as recited in claim 1 further comprising vanadium in an amount of up to about 2 atomic percent.

3. A gamma titanium aluminide alloy as recited in claim 1 wherein the one or both elements consists of chromium in an amount of about 1 to about 2 atomic percent.

4. A gamma titanium aluminide alloy as recited in claim 1 wherein the one or more elements consists of manganese in an amount of about 1 to about 2 atomic percent.

5. A gamma titanium aluminide alloy as recited in claim 1 further comprising vanadium in an amount of about 1 to about 2 atomic percent.

6. A gamma titanium aluminide alloy based on an intermetallic compound TiAl, the gamma titanium aluminide alloy consisting essentially of:

aluminum in an amount of about 45.5 to about 46.5 atomic percent;

niobium in an amount of about 3 to about 5 atomic percent;

tungsten in an amount of about 0.5 to about 1.5 atomic percent; and one or both elements selected from the group consisting of chromium and manganese, each of the one or both elements selected being present in an amount of from about 1to about 2 atomic percent;

with the balance being titanium;

whereby the gamma titanium aluminide alloy exhibits oxidation resistance and fracture toughness.

7. A gamma titanium aluminide alloy as recited in claim 6 wherein the one or both elements consists of chromium and manganese.

8. A gamma titanium aluminide alloy as recited in claim 6 further comprising vanadium in an amount of up to about 2 atomic percent.

9. A gamma titanium aluminide alloy as recited in claim 6 wherein the one or both elements consists of chromium in an amount of about 1 to about 2 atomic percent.

10. A gamma titanium aluminide alloy as recited in claim 6 wherein the one or both elements consists of manganese in an amount of about 1 to about 2 atomic percent.

11. A gamma titanium aluminide alloy as recited in claim 6 further comprising vanadium in an amount of about 1 to about 2 atomic percent.

12. A gamma titanium aluminide alloy based on an intermetallic compound TiAl, the gamma titanium aluminide consisting essentially of:

aluminum in an amount of about 45 to about 47 atomic percent;

niobium in an amount of about 5 atomic percent; and tungsten in an amount of about 0.25 to about 2 atomic percent;

with the balance being titanium;

whereby the gamma titanium aluminide alloy exhibits oxidation resistance and fracture toughness.

13. A gamma titanium aluminide alloy as recited in claim 12 further comprising manganese in an amount of up to about 2 atomic percent.

14. A gamma titanium aluminide alloy as recited in claim 12 wherein the tungsten is present in an amount of about 1 atomic percent.

15. A gamma titanium aluminide alloy as recited in claim 12 further comprising vanadium in an amount of up to about 2 atomic percent.

16. A gamma titanium aluminide alloy as recited in claim 12 further comprising chromium in an amount of up to about 2 atomic percent.

17. A gamma titanium aluminide alloy as recited in claim 12 further comprising one or more elements selected from the group consisting of vanadium, chromium and manganese, wherein each of the one or more elements selected is present in an amount of up to about 2 atomic percent.

* * * * *